US010883696B2

(12) United States Patent
Kondo

(10) Patent No.: US 10,883,696 B2
(45) Date of Patent: Jan. 5, 2021

(54) LIGHTING TOOL FOR VEHICLE

(71) Applicant: STANLEY ELECTRIC CO., LTD., Tokyo (JP)

(72) Inventor: Yosuke Kondo, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 17 days.

(21) Appl. No.: 16/358,129

(22) Filed: Mar. 19, 2019

(65) Prior Publication Data

US 2019/0293258 A1 Sep. 26, 2019

(30) Foreign Application Priority Data

Mar. 22, 2018 (JP) ..... 2018-053814

(51) Int. Cl.

| | |
|---|---|
| ***F21S 45/47*** | (2018.01) |
| ***F21S 41/148*** | (2018.01) |
| ***F21S 41/32*** | (2018.01) |
| ***F21S 41/40*** | (2018.01) |
| ***F21S 41/25*** | (2018.01) |
| ***F21S 41/663*** | (2018.01) |
| ***F21S 41/19*** | (2018.01) |
| *F21Y 115/10* | (2016.01) |
| *F21W 102/135* | (2018.01) |

(52) U.S. Cl.

CPC ..... *F21S 45/47* (2018.01); *F21S 41/148* (2018.01); *F21S 41/19* (2018.01); *F21S 41/25* (2018.01); *F21S 41/321* (2018.01); *F21S 41/40* (2018.01); *F21S 41/663* (2018.01); *F21W 2102/135* (2018.01); *F21Y 2115/10* (2016.08)

(58) Field of Classification Search

CPC . F21S 41/148; F21S 41/663; F21W 2102/135
See application file for complete search history.

(56) References Cited

U.S. PATENT DOCUMENTS

| | | | | |
|---|---|---|---|---|
| 8,007,286 | B1 | 8/2011 | Holec et al. | |
| 2017/0241605 | A1* | 8/2017 | Yamamoto ..... | F21S 41/338 |

FOREIGN PATENT DOCUMENTS

| | | | |
|---|---|---|---|
| EP | 2 690 343 | A1 | 1/2014 |
| EP | 2 980 866 | A1 | 2/2016 |
| JP | 2015-179641 | A | 10/2015 |
| WO | 2007/039089 | A1 | 4/2007 |
| WO | 2009/138374 | A1 | 11/2009 |

OTHER PUBLICATIONS

Extended European Search Report for the related European Patent Application No. 19163758.6 dated Aug. 9, 2019.

* cited by examiner

*Primary Examiner* — Joseph L Williams
*Assistant Examiner* — Jacob R Stern
(74) *Attorney, Agent, or Firm* — Kenealy Vaidya LLP

(57) ABSTRACT

A lighting tool for a vehicle includes a first light source unit having a plurality of first light emitting elements and a first heat conductive substrate on which the first light emitting elements are mounted, and a second light source unit having at least one or a plurality of second light emitting elements and a second heat conductive substrate on which the second light emitting element is mounted, wherein the first heat conductive substrate is thermally bonded to the second heat conductive substrate in a state in which the first heat conductive substrate and the second heat conductive substrate are overlapped with each other.

13 Claims, 7 Drawing Sheets

LIGHTING TOOL FOR VEHICLE

CROSS-REFERENCE TO RELATED APPLICATION

Priority is claimed on Japanese Patent Application No. 2018-053814, filed Mar. 22, 2018, the content of which is incorporated herein by reference.

BACKGROUND

Field of the Invention

The present invention relates to a lighting tool for a vehicle.

Description of Related Art

For example, a lighting tool for a vehicle such as a headlight for a vehicle (a headlamp) or the like includes a light source, a reflector configured to reflect light emitted from the light source in a direction of advance of the vehicle, a shade configured to block (cut) some of the light reflected by the reflector, and a projection lens configured to project the light, some of which is cut by the shade in the direction of advance of the vehicle. In such a lighting tool for a vehicle, when a light source image defined by a front end of the shade is projected by the projection lens as a passing beam (a low beam), a light distribution pattern for a low beam including a cutoff line at an upper end is formed. In addition, in the lighting tool for a vehicle, when another light source is disposed below the shade and light emitted from the light source is projected by the projection lens in the direction of advance of the vehicle as a traveling beam (a high beam), a light distribution pattern for a high beam is formed above the light distribution pattern for a low beam.

Meanwhile, in a lighting tool for a vehicle, a light source and a reflector including a plurality of reflecting surfaces that are separate may be provided, and when light emitted from the light source is reflected by the plurality of reflecting surfaces of the reflector in the direction of advance of the vehicle as a passing beam (a low beam) while adjusting a light distribution, a light distribution pattern for a low beam including a cutoff line at an upper end is formed. In addition, in a lighting tool for a vehicle, unlike the above-mentioned light source unit including the light source for a low beam and the reflector, a light source unit including a light source and a reflector having a plurality of reflecting surfaces that are separate may be disposed, and when light emitted from the light source is reflected by the plurality of reflecting surfaces of the reflector in a direction of advance of a vehicle as a traveling beam (a high beam) while adjusting a light distribution, a light distribution pattern for a high beam is formed above the light distribution pattern for a low beam (for example, see Japanese Unexamined Patent Application, First Publication No. 2015-179641).

Further, recently, development of a light distribution variable headlamp (ADB: adaptive driving beam) configured to variably control a light distribution of a light distribution pattern for a high beam when light emitting elements such as light emitting diodes (LEDs) or the like are disposed and lighting up of the light emitting elements is switched between has also advanced. An ADB is a technology of recognizing a preceding vehicle, an oncoming vehicle, a pedestrian, or the like, using an on-vehicle camera, and enlarging a field of view in front of a driver at nighttime without causing glare for a driver in an oncoming vehicle or a pedestrian.

Incidentally, the above-mentioned LED has a merit that power consumption is low for a long time. Meanwhile, since a high temperature causes a decrease in emission efficiency or shortening of a lifetime, heat emitted from the LED needs to be efficiently radiated to the outside using a heat sink, a cooling fan, or the like.

However, when a heat sink, a cooling fan, or the like, is used, it causes an increase in size and weight of a light body as well as increase in costs. Here, since heat dissipation from a circuit board formed of a metal is increased by using a metal plate on the circuit board on which the LED is mounted, a configuration in which a heat sink or a cooling fan is not required has been proposed (for example, see Japanese Unexamined Patent Application, First Publication No. 2015-179641).

SUMMARY OF THE INVENTION

Incidentally, since a light source unit configured to form a light distribution pattern for a low beam and a light source unit configured to form a light distribution pattern for a high beam have different emission directions of light, they are configured as separate bodies. Here, since reduction in costs due to omission of a number of parts and simplification of an assembly process can be achieved, development of the lighting tool for a vehicle in which these light source units are integrated has advanced.

However, when the light source units are integrated, it is required to increase a thickness or a size of a circuit board of each of the light source units and increase heat dissipation in the above-mentioned circuit board formed of metal. In this case, an increase in size of the light body due to securing of a space in which the circuit board of each of the light source units is disposed may occur.

An aspect of the present invention is directed to providing a lighting tool for a vehicle which is able to be further reduced in size while heat dissipation therefrom is increased.

In order to accomplish the above-mentioned object, the present invention provides the following means.

[1] A lighting tool for a vehicle including:

a first light source unit having a plurality of first light emitting elements and a first heat conductive substrate on which the first light emitting elements are mounted; and a second light source unit having at least one or a plurality of second light emitting elements and a second heat conductive substrate on which the second light emitting element is mounted, wherein the first heat conductive substrate is thermally bonded to the second heat conductive substrate in a state in which the first heat conductive substrate and the second heat conductive substrate are overlapped with each other.

[2] The lighting tool for a vehicle according to the aspect [1], wherein the second heat conductive substrate has a substrate mounting region on a surface of at side on which the second light emitting element is mounted, and the first heat conductive substrate is thermally bonded to the second heat conductive substrate while the first heat conductive substrate being mounted in the substrate mounting region.

[3] The lighting tool for a vehicle according to the aspect [1] or [2], wherein the first heat conductive substrate and the second heat conductive substrate comprise metal plate.

[4] The lighting tool for a vehicle according to any one of the aspects [1] to [3], wherein the first light source unit variably controls a light distribution pattern of light emitted from the plurality of first light emitting elements while switching lighting of the plurality of first light emitting elements.

[5] The lighting tool for a vehicle according to any one of the aspects [1] to [4], wherein the second light source unit has a reflector configured to reflect light emitted from the second light emitting element, a shade configured to block some of the light reflected by the reflector and a projection lens configured to project the light, some of which is blocked by the shade, and forms a light distribution pattern comprising a cutoff line at an upper end thereof by reversely projecting a light source image defined by a front end of the shade using the projection lens.

[6] The lighting tool for a vehicle according to any one of the aspects [1] to [4], wherein the second light source unit has a reflector comprising a plurality of reflecting surfaces, and is configured to form a light distribution pattern comprising a cutoff line at an upper end thereof by reflecting light emitted from the second light emitting element using the plurality of reflecting surfaces of the reflector.

[7] The lighting tool for a vehicle according to any one of the aspects [1] to [6], wherein the first light source unit has a first reflector configured to reflect light emitted from the first light emitting element, the second light source unit has a second reflector configured to reflect light emitted from the second light emitting element, and the first reflector and the second reflector are integrally formed so as to be arranged next to each other in a widthwise direction.

As described above, according to the aspects of the present invention, it is possible to provide a lighting tool for a vehicle which is able to be further reduced in size while heat dissipation therefrom is increased.

DETAILED DESCRIPTION OF THE INVENTION

Figure 1:
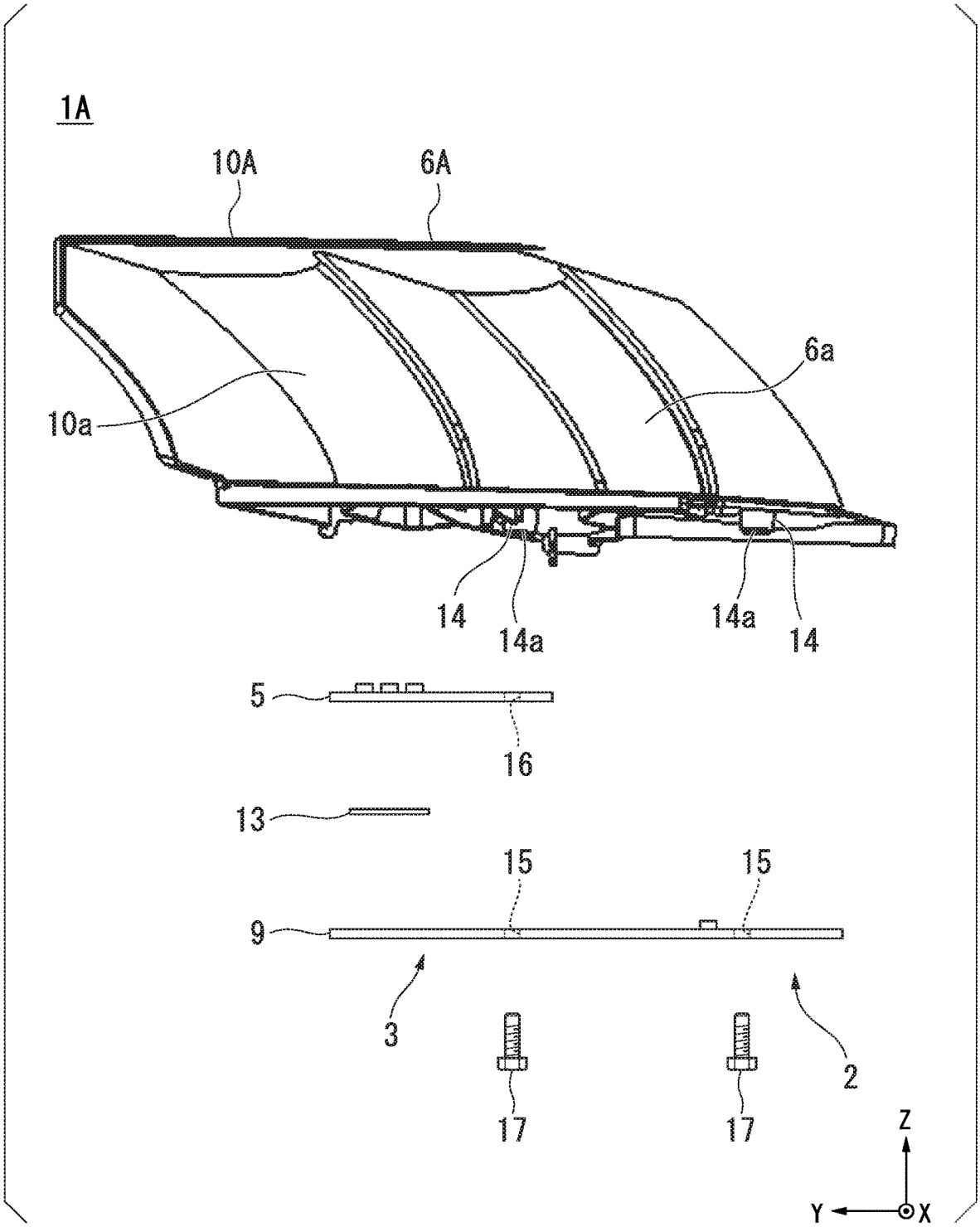
FIG. 1 is an exploded perspective view showing a schematic configuration of a lighting tool for a vehicle according to a first embodiment of the present invention.

Hereinafter, embodiments of the present invention will be described in detail with reference to the accompanying drawings.

Further, in the drawings used in the following description, in order to make the components easier to see, scales of dimensions may be shown differently depending on the components, and dimensional ratios or the like between the components are not necessarily the same as actual ones.

First Embodiment

First, for example, a lighting tool 1A for a vehicle shown in FIG. 1 to FIG. 6 will be described as a first embodiment of the present invention.

Figure 2:
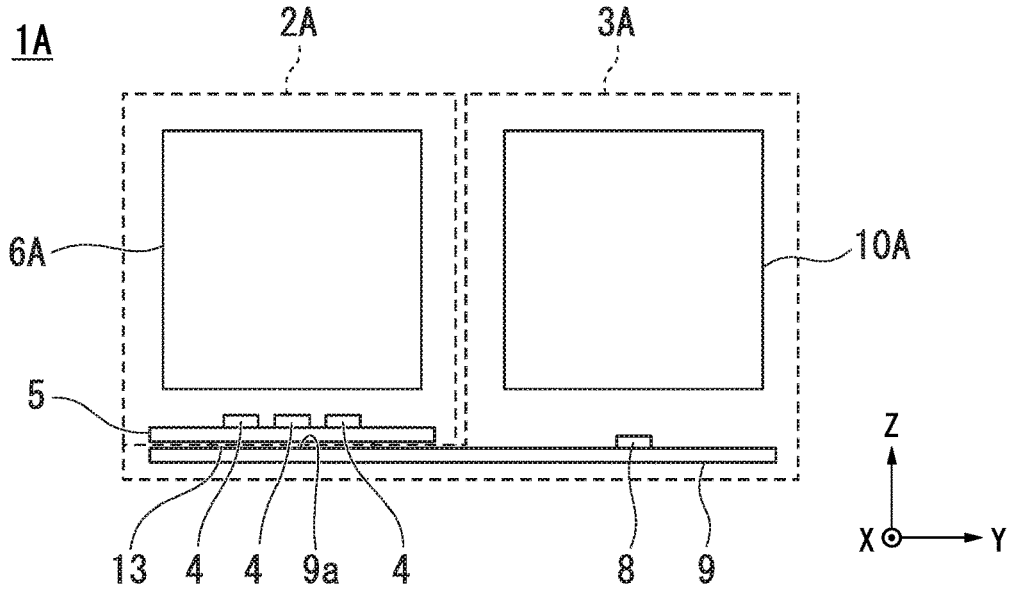
FIG. 2 is a schematic view showing the lighting tool for a vehicle shown in FIG. 1 when seen from a front side.
Figure 3:
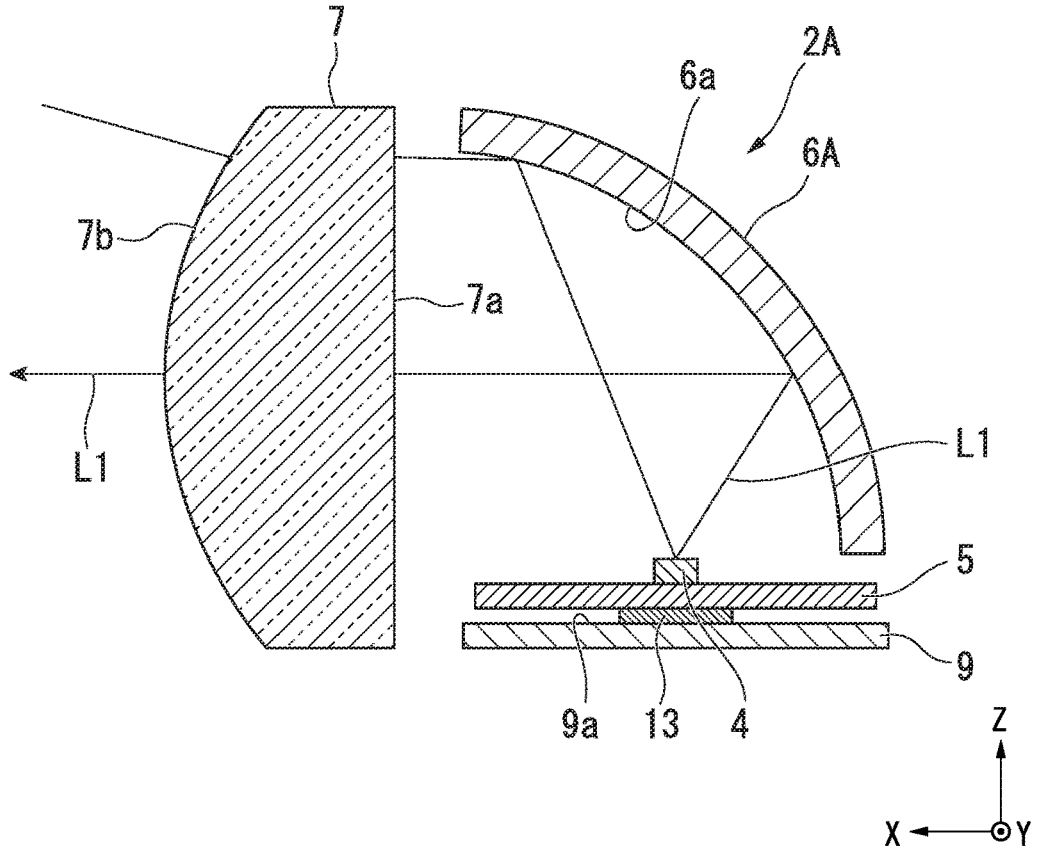
FIG. 3 is a schematic view of a first light source unit provided in the lighting tool for a vehicle shown in FIG. 1 when seen from a side.
Figure 4A:
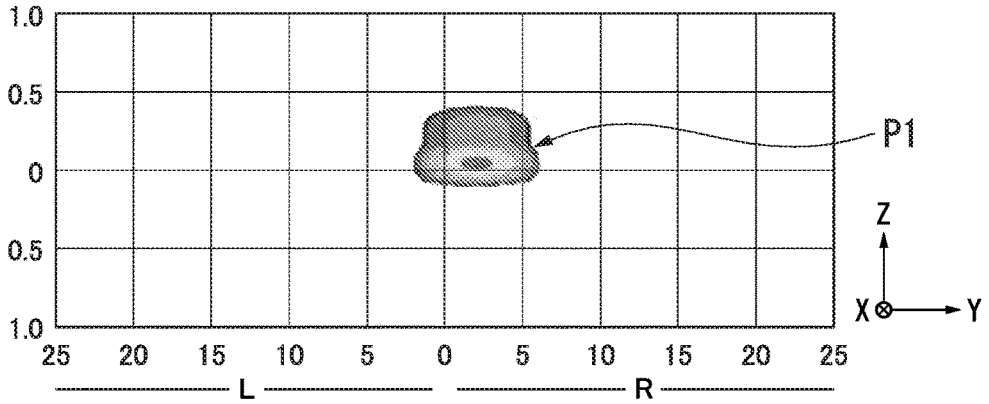
FIG. 4A is a schematic view showing a projection image of first light emitted from each of first light emitting elements of a first light source unit shown in FIG. 3.
Figure 4B:
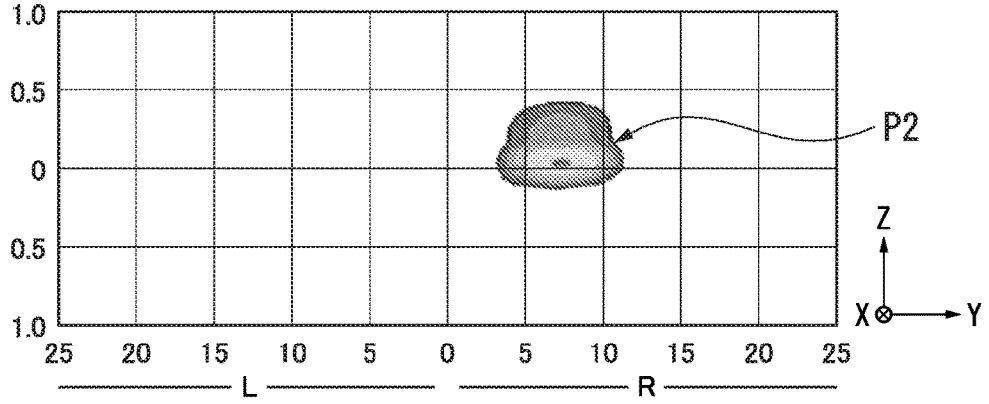
FIG. 4B is a schematic view showing a projection image of first light emitted from each of the first light emitting elements of the first light source unit shown in FIG. 3.
Figure 4C:
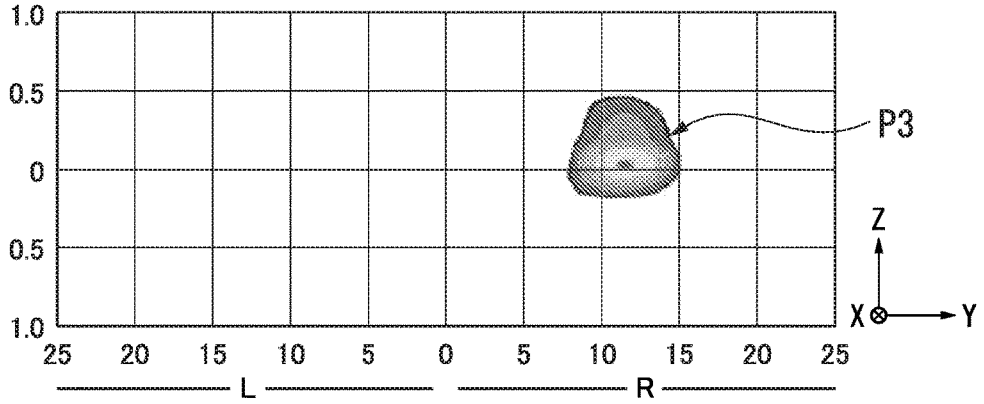
FIG. 4C is a schematic view showing a projection image of first light emitted from each of the first light emitting element of the first light source unit shown in FIG. 3.
Figure 5:
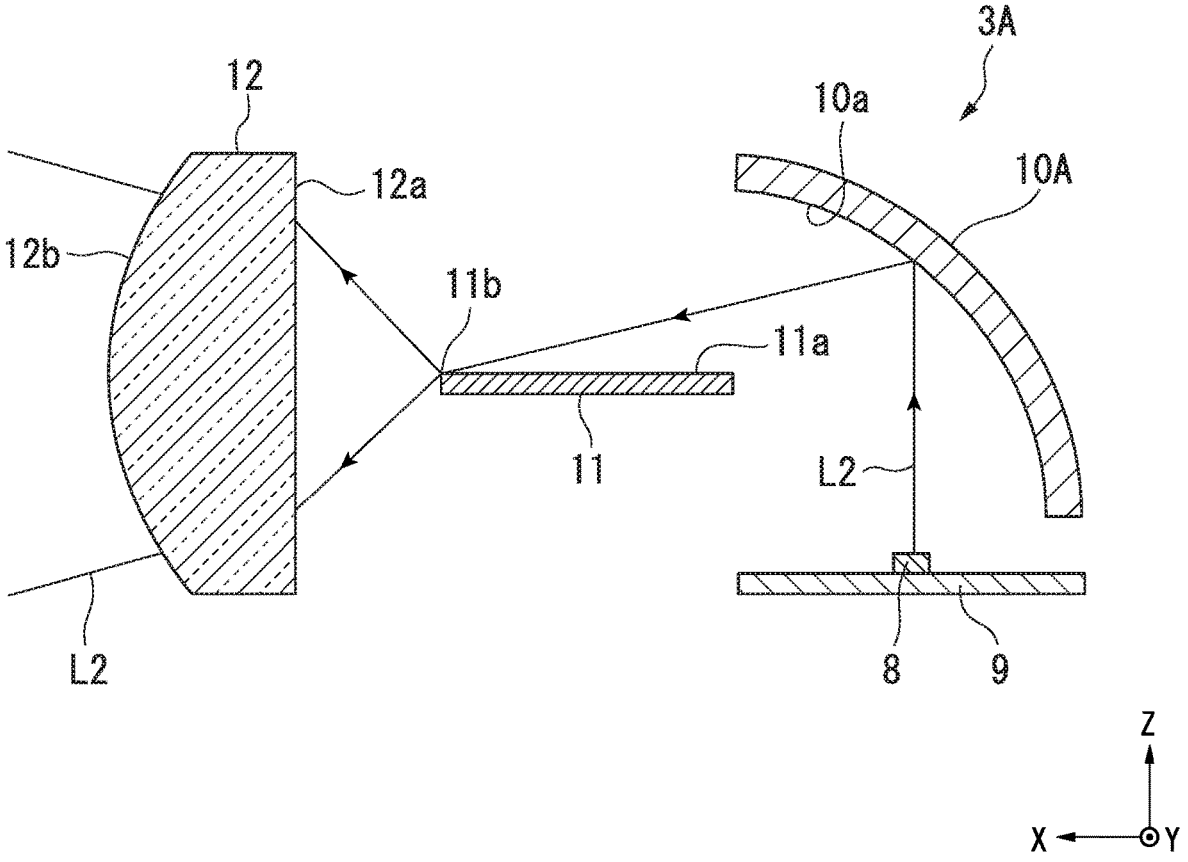
FIG. 5 is a schematic view of a second light source unit provided in the lighting tool for a vehicle shown in FIG. 1 when seen from a side.
Figure 6:
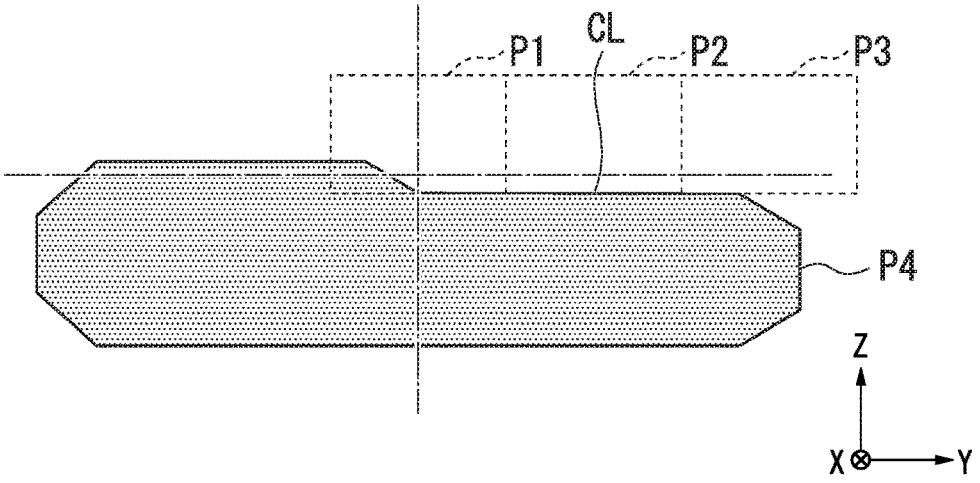
FIG. 6 is a schematic view showing a projection image of second light emitted from a second light emitting element of the second light source unit shown in FIG. 5.

First, FIG. 1 is an exploded perspective view showing a schematic configuration of the lighting tool 1A for a vehicle. FIG. 2 is a schematic view of the lighting tool 1A for a vehicle when seen from a front side. FIG. 3 is a schematic view of a first light source unit 2A provided in the lighting tool 1A for a vehicle when seen from a side. FIG. 4A, FIG. 4B and FIG. 4C are schematic views showing projection images of first light L1 emitted from each of the first light emitting elements 4 of the first light source unit 2A. FIG. 5 is a schematic view of a second light source unit 3A provided in the lighting tool 1A for a vehicle when seen from a side. FIG. 6 is a schematic view showing a projection image of second light L2 emitted from second light emitting elements 8 of the second light source unit 3A. Further, in FIG. 1 and FIG. 2, a first projection lens 7 and a second projection lens 12, which will be described below, are omitted.

In addition, in the drawings as described below, an XYZ orthogonal coordinate system is set, an X-axis direction represents a forward/rearward direction (a lengthwise direction) with respect to the lighting tool 1A for a vehicle, a Y-axis direction represents a leftward/rightward direction (a widthwise direction) with respect to the lighting tool 1A for a vehicle, and a Z-axis direction represents an upward/downward direction (a height direction) with respect to the lighting tool 1A for a vehicle.

In addition, in the following description, directions of forward, rearward, leftward, rightward, upward and downward are the same when the lighting tool 1A for a vehicle is seen from a front side (a side in front of a vehicle unless the context clearly indicates otherwise.

The lighting tool 1A for a vehicle of the embodiment is, for example, a lighting tool in which the present invention is applied to headlights for a vehicle (headlamps) mounted on both of corner sections of a front end side of a vehicle (not shown). In addition, the lighting tool 1A for a vehicle of the embodiment serving as a headlight for a vehicle (a headlamp) is configured to radiate a passing beam (a low beam) and a traveling beam (a high beam) in a direction of advance of a vehicle (a +X-axis direction). Further, the lighting tool 1A for a vehicle of the embodiment constitutes a light distribution variable headlamp (ADB) configured to variably control a light distribution of a traveling beam (a high beam).

Specifically, as shown in FIG. 1 and FIG. 2, the lighting tool 1A for a vehicle generally includes the first light source unit 2A and the second light source unit 3A. The first light source unit 2A and the second light source unit 3A are disposed accommodated inside a light body (not shown) that constitutes the lighting tool 1A for a vehicle.

The first light source unit 2A constitutes a light distribution variable headlamp (ADB) configured to variably control a light distribution of first light L1 while radiating the first light L1 that constitutes a traveling beam (a high beam) in a direction of advance of a vehicle.

As shown in FIG. 1, FIG. 2 and FIG. 3, the first light source unit 2A has a plurality of (in the embodiment, three) first light emitting elements 4, a first heat conductive substrate 5 on which the first light emitting elements 4 are mounted, a first reflector 6A configured to reflect first light L1 emitted from the first light emitting elements 4, and the first projection lens 7 configured to project the first light L1 reflected by the first reflector 6A in a direction of advance of a vehicle. Further, in FIG. 1, illustration of the first projection lens 7 shown in FIG. 2 and FIG. 3 is omitted.

The first light emitting elements 4 are constituted by chip LEDs (SMD LEDs) configured to emit white light as the first light L1. In addition, a high output type LED for vehicle illumination is used as the chip LED. The plurality of first light emitting elements 4 are disposed on a surface of the first heat conductive substrate 5 so as to be arranged next to each other in a direction corresponding to a vehicle width direction (a Y-axis direction). The first light emitting elements 4 radially emit first light L1 toward the first reflector 6A provided at an upper side.

The first heat conductive substrate 5 is formed in a substantially rectangular shape when seen in a plan view using a steel plate such as a zinc-coated steel plate, a nickel-coated steel plate, or the like, or a metal plate having good thermal conductivity such as an aluminum plate, a copper plate or the like. A wiring pattern electrically connected to the first light emitting elements 4 via an insulating layer, while not shown, is provided on a surface of the metal plate. An insulating film formed through, for example, chromating, alumite treatment (surface oxidation) or coating is used as the insulating layer.

In the lighting tool 1A for a vehicle of the embodiment, a first heat conductive substrate (a mounting substrate) 5 on which the first light emitting elements 4 are mounted and a circuit board (not shown) on which a driving circuit configured to drive the first light emitting elements 4 is provided are separately disposed in the light body, the mounting substrate and the circuit board are electrically connected via a wiring cord that is referred to as a harness, and the driving circuit can be protected from heat emitted from the first light emitting elements 4.

The first reflector 6A is constituted by a reflecting member made of die-cast aluminum or the like. The first reflector 6A is disposed to cover the first heat conductive substrate 5 from above, which is disposed in a state in which the first light emitting elements 4 are directed upward. In addition, a surface (an inner surface) of the first reflector 6A facing the first light emitting elements 4 becomes a reflecting surface 6*a*.

The reflecting surface 6*a* of the first reflector 6A is formed to be curved to describe a parabola from a base end (rear end) side toward a tip (front end) using a center (an emission point) of the first light emitting elements 4 as a focus in a cross section (an X-axis cross section) in a forward/rearward direction (an X-axis direction). Accordingly, the first reflector 6A reflects the first light L1 emitted from the first light emitting elements 4 such that it becomes parallel beams in a direction of advance of a vehicle (an +X-axis direction) using the reflecting surface 6*a*.

The first projection lens 7 is disposed in front of the first reflector 6A and projects the first light L1 in the direction of advance of the vehicle (the +X-axis direction). Further, a material, for example, a transparent resin such as polycarbonate, acryl, or the like, a glass, or the like, having a higher refractive index than that of air, may be used for the first projection lens 7.

The first projection lens 7 has a configuration in which an incident surface 7*a* to which the first light L1 enters and an emission surface 7*b* from which the first light L1 exits are disposed in sequence in the direction of advance of the vehicle (the +X-axis direction).

The incident surface 7*a* is disposed on a rear end (a rear surface) side of the first projection lens 7, and the first light L1 enters the first projection lens 7 from the incident surface 7*a*. Further, in the incident surface 7*a*, while a cross-sectional shape in a vertical direction (a Z-axis direction) is a linear shape, the cross-sectional shape is not particularly limited and, for example, may be a concave lens surface.

The emission surface 7*b* is configured as a cylindrical lens surface disposed on a front end (front surface) side of the first projection lens 7 and extending in a horizontal direction (a Y-axis direction) such that the first light L1 emitted from the emission surface 7*b* to the outside of the first projection lens 7 is condensed in the vertical direction (the Z-axis direction).

Further, the emission surface 7*b* is not limited to the above-mentioned cylindrical lens surface and may be a toric lens surface curved in the horizontal direction (the Y-axis direction). In this case, the first light L1 emitted from the emission surface 7*b* can be condensed not only in the vertical direction (the Z-axis direction) but also be condensed and diffused in the horizontal direction (the Y-axis direction).

In the first light source unit 2A, as shown in FIG. 4A, FIG. 4B and FIG. 4C, light distribution patterns (hereinafter, referred to as light distribution patterns for ADB) P1 to P3 of the first light L1 projected by the first projection lens 7 are variably controlled while switching lighting of the plurality of first light emitting elements 4.

Further, FIG. 4A, FIG. 4B and FIG. 4C show light source images (light distribution patterns for ADB) when the first light L1 radiated to a side in front of the first projection lens 7 is projected to a virtual vertical screen of the first light source unit 2A facing the first projection lens 7. In addition, FIG. 4A, FIG. 4B and FIG. 4C show light distribution patterns in which a vehicle is in a left-hand traffic area. Further, when the vehicle is in a right-hand traffic area, light distribution patterns (not shown) are obtained by laterally inverting the light distribution patterns shown in FIG. 4A, FIG. 4B and FIG. 4C.

Among these, FIG. 4A shows the light distribution pattern P1 for ADB when the first light emitting element 4 disposed on the leftmost side of the plurality of (three) first light emitting elements 4, arranged in the vehicle width direction is turned ON. FIG. 4B shows the light distribution pattern P2 for ADB when the first light emitting element 4 disposed at a center is turned ON. FIG. 4C shows the light distribution pattern P3 for ADB when the first light emitting element 4 disposed on the rightmost side is turned ON. Further, a lateral axis and a vertical axis shown in FIG. 4A, FIG. 4B and FIG. 4C are angles, and an intersection position of 0° is a front position on a virtual screen.

In the light distribution patterns P1 to P3 for ADB, an obstacle such as a preceding vehicle, an oncoming vehicle, a pedestrian, or the like, is recognized using an on-vehicle camera, and a light distribution pattern in which the first light emitting element 4, among the plurality of first light emitting elements 4, of a portion corresponding to the obstacle is turned OFF and the remaining first light emitting elements 4 are turned ON is provided. For example, when an oncoming vehicle is present in the vicinity of 2.5° of a front right side, the first light emitting element 4 disposed on the leftmost side is turned OFF, the first light emitting element 4 disposed at the center and the first light emitting element 4 disposed on the rightmost side are turned ON, and a light distribution pattern in which both of the light distribution patterns P1 and P2 for ADB are synthesized is provided.

The second light source unit 3A constitutes a light source unit for a low beam (LB) configured to radiate the second light L2 that constitutes a passing beam (a low beam) in a direction of advance of a vehicle.

As shown in FIG. 1, FIG. 2 and FIG. 5, the second light source unit 3A has at least one or a plurality of (in the embodiment, one) second light emitting elements 8, a second heat conductive substrate 9 on which the second light emitting elements 8 are mounted, a second reflector 10A configured to reflect second light L2 emitted from the second light emitting elements 8 in a direction of advance of a vehicle, a shade 11 configured to block some of the second light L2 reflected by the second reflector 10A, and a second projection lens 12 configured to project the second light L2, some of which is blocked by the shade 11, in the direction of advance of the vehicle.

The second light emitting elements 8 are constituted by chip LEDs (SMD LEDs) configured to emit white light as the second light L2. In addition, a high output type LED for vehicle illumination is used for the chip LED. The second light emitting elements 8 are disposed on a surface of the second heat conductive substrate 9. The second light emitting elements 8 radially emit the second light L2 toward the second reflector 10A provided at an upper side.

The second heat conductive substrate 9 is formed in a substantially rectangular shape when seen in a plan view using a steel plate such as a zinc-coated steel plate, a nickel-coated steel plate, or the like, or a metal plate having good thermal conductivity such as an aluminum plate, a copper plate, or the like. While not shown, a wiring pattern electrically connected to the second light emitting elements 8 via an insulating layer is provided on a surface of the metal plate. For example, an insulating film formed through chromating, alumite treatment (surface oxidation) or coating is used on the insulating layer.

In the lighting tool 1A for a vehicle of the embodiment, the second heat conductive substrate (a mounting substrate) 9 on which the second light emitting elements 8 are mounted and a circuit board (not shown) on which a driving circuit configured to drive the second light emitting elements 8 is provided are separately disposed in the light body, the mounting substrate and the circuit board are electrically connected via a wiring cord that is referred to as a harness, and the driving circuit is protected from heat emitted from the second light emitting elements 8.

Further, first heat conductive substrate 5 and the second heat conductive substrate 9 may be formed of the same material or may be formed of different materials. In addition, the circuit board on which the driving circuit configured to drive the first light emitting elements 4 is provided and the circuit board on which the driving circuit configured to drive the second light emitting elements 8 is provided may be formed integrally or may be formed separately from each other.

Meanwhile, the second heat conductive substrate 9 is larger than the first heat conductive substrate 5, and has a substrate mounting region 9*a* on a surface thereof at a side on which the second light emitting elements 8 are mounted. The first heat conductive substrate 5 is mounted on the substrate mounting region 9*a* via a thermal conductive sheet 13. Accordingly, the first heat conductive substrate 5 is thermally bonded to the second heat conductive substrate 9 while they overlap each other. Further, the thermal conductive sheet 13 may be omitted in some cases.

As the first heat conductive substrate 5 and the second heat conductive substrate 9 are laminated, the first and second heat conductive substrates 5 and 9 function as a radiation member. In particular, since the region (the substrate mounting region 9*a*) in which the first heat conductive substrate 5 and the second heat conductive substrate 9 are laminated has a thickness two times larger than that of the region in which they are not laminated, a thermal capacity is increased. Accordingly, in comparison with the case in which the first heat conductive substrate 5 and the second heat conductive substrate 9 are not laminated, larger current can flow to the plurality of first light emitting elements 4.

Further, since heat dissipation in the substrate mounting region 9*a* of the second heat conductive substrate 9 is improved, a radiation area can also be increased by performing unevenness processing or the like with respect to the second heat conductive substrate 9.

The second reflector 10A is constituted by a reflecting member such as die-cast aluminum or the like. The second reflector 10A is disposed to cover the second heat conductive substrate 9 from above, which is disposed in a state in which the second light emitting elements 8 are directed upward. In addition, a surface (an inner surface) of the second reflector 10A facing the second light emitting elements 8 is a reflecting surface 10*a*.

The reflecting surface 10*a* of the second reflector 10A is formed to be curved to draw an elliptic curve from a base end (rear end) side toward a tip (front end) side in a cross section (an X-axis cross section) in the forward/rearward direction (the X-axis direction) using a center (an emission point) of the second light emitting elements 8 as a first focus on a rear side and the vicinity of a focus position of the second projection lens 12 as a second focus on a front side. Accordingly, the second reflector 10A reflects the second light L2 emitted from the second light emitting elements 8 in the direction of advance of the vehicle (the +X-axis direction) using the reflecting surface 10*a*.

In the embodiment, the first reflector 6A and the second reflector 10A are configured integrally with each other. Accordingly, the first heat conductive substrate 5 and the second heat conductive substrate 9 are attached integrally with the first reflector 6A and the second reflector 10A in a state they are overlapped with each other.

Specifically, a pair of bosses 14 in which screw holes 14*a* are formed are provided on the first reflector 6A and the second reflector 10A. Meanwhile, a pair of through-holes 15 are formed in the first heat conductive substrate 5. In addition, a through-hole 16 is formed in the second heat conductive substrate 9 at a position overlapping one of the through-holes 15. Accordingly, since screws 17 are screwed into the screw holes 14*a* through the respective through-holes 15 and 16 in a state in which the first heat conductive substrate 5 and the second heat conductive substrate 9 are overlapped with each other, the first heat conductive substrate 5 and the second heat conductive substrate 9 can be attached integrally with the first reflector 6A and the second reflector 10A.

Further, the first reflector 6A and the second reflector 10A are not limited to the case in which they are configured integrally with each other, and may be configured separately from each other.

The shade 11 is constituted by a flat-plate-shaped reflecting member having an upward reflecting surface 11*a*. The shade 11 has a front end 11*b* disposed in the vicinity of a rear focus of the second projection lens 12, and extends rearward (in an −X-axis direction).

The second projection lens 12 is disposed in front of the second reflector 10A, and projects the second light L2 in the direction of advance of the vehicle (the +X-axis direction). Further, a material having a higher refractive index than that of air, for example, a transparent resin such as poly carbonate, acryl, or the like, glass, or the like, may be used in the second projection lens 12.

The second projection lens 12 has a configuration in which an incident surface 12*a* to which the second light L2 enters and an emission surface 12*b* from which the second light L2 exits are disposed in the direction of advance of the vehicle (the +X-axis direction) in sequence.

The incident surface 12*a* is disposed on a rear end (rear surface) side of the second projection lens 12 and configured as a plane to which the second light L2 enters the second projection lens 12 from the incident surface 12*a*. Further, the incident surface 12*a* is not limited to the above-mentioned plane, and may be a plane inclined forward and downward, a curved surface curved in a concave shape on a front side, or the like.

The emission surface 12*b* is disposed on a front end (front surface) side of the second projection lens 12 and configured as a hemispherical lens surface. Further, the emission surface 12*b* is not limited to the above-mentioned hemispherical lens surface and may be constituted by a plurality of curved surfaces. In this case, the second light L2 emitted from the emission surface 12*b* can be condensed not only in the vertical direction (the Z-axis direction) but also be condensed and diffused in the horizontal direction (the Y-axis direction).

In addition, the first projection lens 7 and the second projection lens 12 are not limited to the case in which they are configured separately from each other and may also be configured integrally with each other.

In the second light source unit 3A, as shown in FIG. 6, when the light source image defined by the front end 11*b* of the shade 11 is reversely projected by the second projection lens 12, the light distribution pattern (hereinafter, referred to as a light distribution pattern for a low beam (LB)) P2 including a cutoff line CL at an upper end is formed.

Further, in FIG. 6, in the first light source unit 2A, a light source image (the light distribution patterns P1 to P3 for ADB) when the first light L1 radiated to a side in front of the first projection lens 7 is projected to a virtual vertical screen facing the first projection lens 7 is show in broken lines.

A light distribution pattern P4 for LB is formed below a horizontal line in a state in which the light distribution pattern P4 for LB is disposed below or partially overlap the light distribution patterns P1 to P3 for ADB. A light distribution pattern for a traveling beam (a high beam) is formed below and above the horizontal line by a synthetic light distribution of the light distribution pattern P4 for LB and the light distribution patterns P1 to P3 for ADB.

In the lighting tool 1A for a vehicle of the embodiment having the above-mentioned configuration, when the first light source unit 2A and the second light source unit 3A are configured integrally with each other, the number of parts can be reduced and further reduction in size can be achieved.

In addition, in the lighting tool 1A for a vehicle of the embodiment, the first heat conductive substrate 5 is thermally bonded to the second heat conductive substrate 9 in a state they are overlapped with each other. Accordingly, there is no need to secure a space in which a circuit board is disposed on each light source unit like in the related art, and a compact design in a size of the light body can be achieved.

In addition, in the lighting tool 1A for a vehicle of the embodiment, when the first light source unit 2A is turned ON, heat emitted from the first light emitting elements 4 can be efficiently radiated from the first heat conductive substrate 5 to the second heat conductive substrate 9.

Further, when any one of the first light source unit 2A and the second light source unit 3A is turned ON, the other light source unit is turned OFF, and thus, it is possible to maintain heat dissipation performance even more.

As described above, according to the embodiment, it is possible to provide the lighting tool 1A for a vehicle which is able to be further reduced in size while heat dissipation therefrom is increased.

Second Embodiment

Next, for example, a lighting tool 1B for a vehicle shown in FIG. 7 to FIG. 10 will be described as a second embodiment of the present invention.

Figure 7:
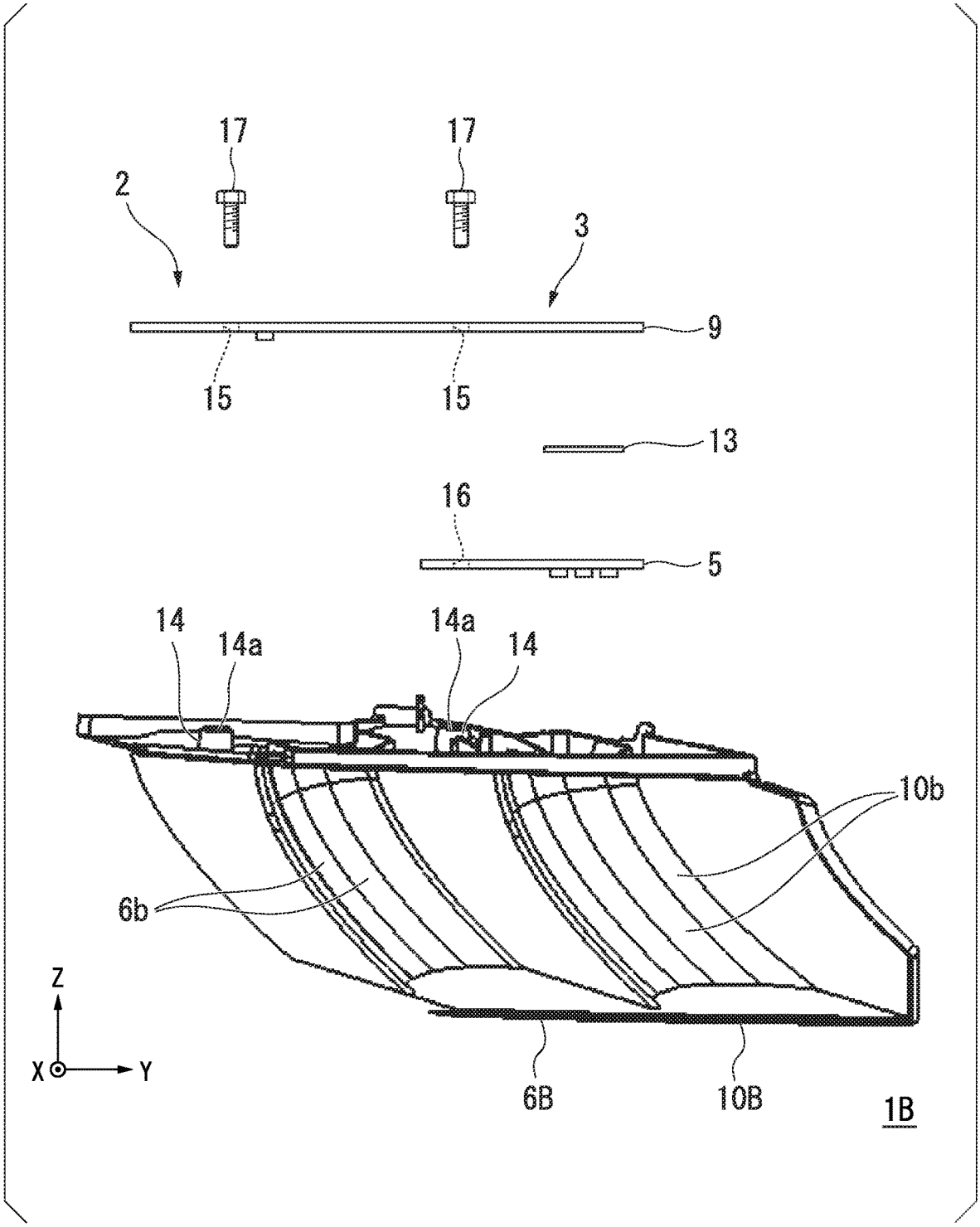
FIG. 7 is an exploded perspective view of a schematic configuration of a lighting tool for a vehicle according to a second embodiment of the present invention.
Figure 8:
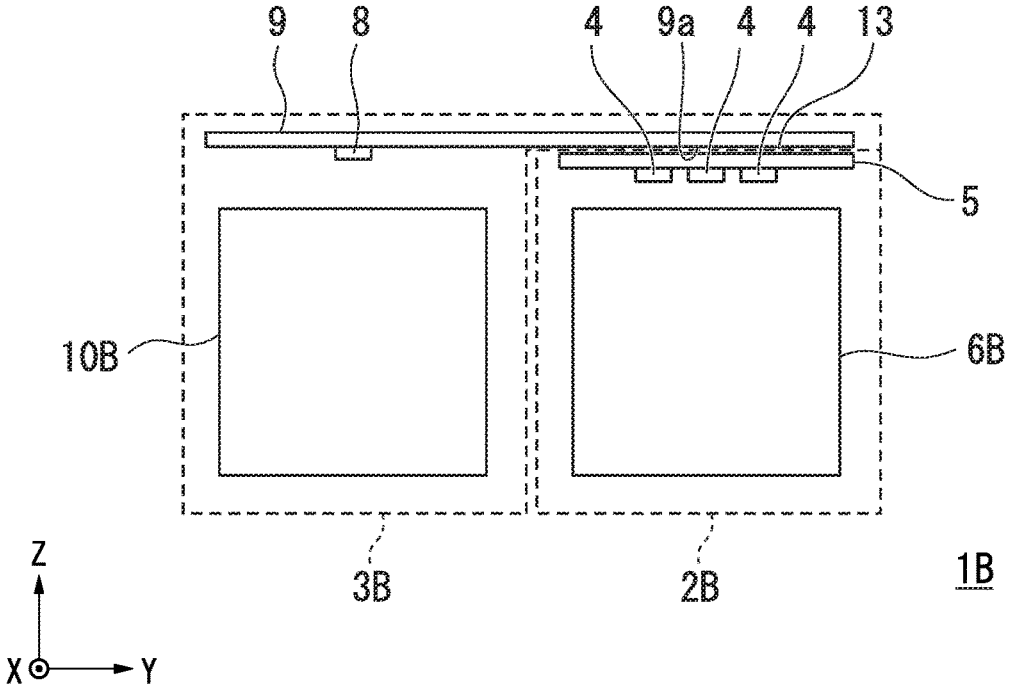
FIG. 8 is a schematic view of the lighting tool for a vehicle shown in FIG. 7 when seen from a front side.
Figure 9:
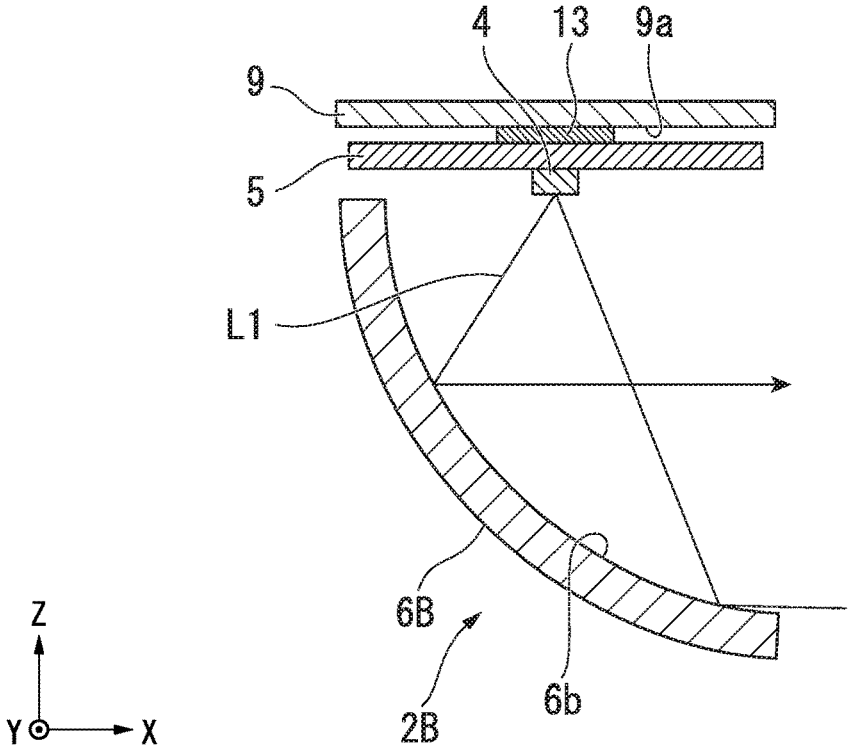
FIG. 9 is a schematic view of a first light source unit provided in the lighting tool for a vehicle shown in FIG. 7 when seen from a side.
Figure 10:
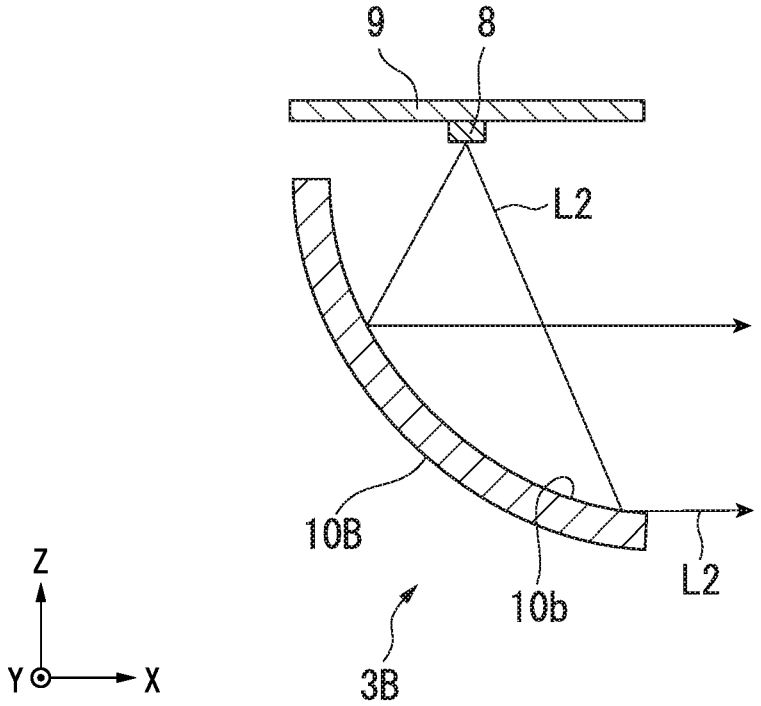
FIG. 10 is a schematic view of a second light source unit provided in the lighting tool for a vehicle shown in FIG. 7 when seen from a side.

Further, FIG. 7 is an exploded perspective view showing a schematic configuration of the lighting tool 1B for a vehicle. FIG. 8 is a schematic view of the lighting tool 1B for a vehicle when seen from a front side. FIG. 9 is a schematic view of a first light source unit 2B provided in the lighting tool 1B for a vehicle when seen from a side. FIG. 10 is a schematic view of a second light source unit 3B provided in the lighting tool 1B for a vehicle when seen from a side. In addition, in the following description, the same components as in the lighting tool 1A for a vehicle, descriptions of which are omitted, are designated by the same reference numerals in the drawings.

Like the lighting tool 1A for a vehicle, the lighting tool 1B for a vehicle of the embodiment serving as a headlight for a vehicle (headlamp) is configured to radiate a passing beam (a low beam) and a traveling beam (a high beam) in a direction of advance of a vehicle (a +X-axis direction). Further, the lighting tool 1B for a vehicle of the embodiment constitutes a light distribution variable headlamp (ADB) configured to variably control a light distribution for a traveling beam (a high beam).

Meanwhile, while the lighting tool 1A for a vehicle is a projector type using the projection lens (the first projection lens 7 and the second projection lens 12), the lighting tool 1B for a vehicle of the embodiment is a reflector type lighting tool for a vehicle, from which the projection lens is omitted.

Specifically, as shown in FIG. 7 and FIG. 8, the lighting tool 1B for a vehicle generally includes the first light source unit 2B and the second light source unit 3B. The first light source unit 2B and the second light source unit 3B are disposed in a state in which they are accommodated in a light body (not shown) that constitutes the lighting tool 1B for a vehicle.

As shown in FIG. 7, FIG. 8 and FIG. 9, the first light source unit 2B constitutes a light distribution variable headlamp (ADB) configured to radiate first light L1 that constitutes a traveling beam (a high beam) in a direction of advance of a vehicle and variably control a light distribution of the first light L1.

The first light source unit 2B has a plurality of (in the embodiment, three) first light emitting elements 4, a first heat conductive substrate 5 on which the first light emitting elements 4 are mounted, and a first reflector 6B configured to reflect the first light L1 emitted downward from the first light emitting elements 4 in the direction of advance of the vehicle.

The first light emitting elements 4 are constituted by chip LEDs (SMD LEDs) configured to emit white light as the first light L1. In addition, a high output type LED for vehicle illumination is used for the chip LED. The plurality of first light emitting elements 4 are disposed on a surface of the first heat conductive substrate 5 so as to be arranged next to each other in a direction corresponding to the vehicle width direction (the Y-axis direction). The first light emitting elements 4 radially emits the first light L1 toward the first reflector 6B provided downward.

Like the first embodiment, the first heat conductive substrate 5 is formed of a metal plate having good thermal conductivity in a substantially rectangular shape when seen in a plan view.

In the lighting tool 1B for a vehicle of the embodiment, a first heat conductive substrate (a mounting substrate) 5 on which the first light emitting elements 4 are mounted and a circuit board (not shown) on which a driving circuit configured to drive the first light emitting elements 4 is provided are separately disposed inside a light body, the mounting substrate and the circuit board are electrically connected via a wiring cord that is referred to as a harness, and the driving circuit is protected from heat emitted from the first light emitting elements 4.

The first reflector 6B has a plurality of reflecting surfaces 6*b* formed of a resin material such as poly carbonate or the like and each having an inner surface formed of an aluminum-based reflection metal material. The first reflector 6B is disposed to cover the first heat conductive substrate 5 from below, which is disposed in a state in which the first light emitting elements 4 are directed downward. Accordingly, a surface (an inner surface) of the first reflector 6B facing the first light emitting elements 4 become the plurality of reflecting surfaces 6*b*.

As shown in FIG. 9, each of the reflecting surfaces 6*b* of the first reflector 6B is formed to be curved to described a parabola in a cross section (an X-axis cross section) in the forward/rearward direction (the X-axis direction) from a base end (rear end) side toward a tip (front end) side using a center (an emission point) of the first light emitting elements 4 as a focus.

Accordingly, the first reflector 6B reflects the first light L1 emitted from the first light emitting elements 4 to become parallel beams in the direction of advance of the vehicle (the +X-axis direction) using the plurality of reflecting surfaces 6*b*. In addition, as shown in FIG. 7, the plurality of reflecting surfaces 6*b* are constituted by composite reflecting surfaces, each of which is formed to be divided into a plurality of regions, and an irradiating direction and an irradiating range in a reflecting direction of each of the reflecting surfaces 6*b*, in particular, the leftward/rightward direction, are controlled.

In the first light source unit 2B, a light distribution pattern of the first light L1 for ADB emitted from the plurality of first light emitting elements 4 is variably controlled while switching lighting of the plurality of first light emitting elements 4. Further, like the light distribution patterns P1 to P3 for ADB shown in FIG. 4A, FIG. 4B and FIG. 4C, a light distribution of the light distribution pattern for ADB of the embodiment is variably controlled.

That is, in the light distribution patterns P1 to P3 for ADB, an obstacle such as a preceding vehicle, an oncoming vehicle, a pedestrian, or the like, is recognized using an on-vehicle camera, and a light distribution pattern in which the first light emitting element 4, among the plurality of first light emitting elements 4, of a portion corresponding to the obstacle is turned OFF and the remaining first light emitting elements 4 are turned ON is provided. For example, when an oncoming vehicle is present in the vicinity of 2.5° of a front right side, the first light emitting element 4 disposed on the leftmost side is turned OFF, the first light emitting element 4 disposed at a center and the first light emitting element 4 disposed on the rightmost side are turned ON, and thereby, a light distribution pattern in which both of the light distribution patterns P1 and P2 for ADB are synthesized is provided.

The second light source unit 3B constitutes a light source unit for a low beam (LB) configured to radiate the second light L2 that constitutes a passing beam (a low beam) in the direction of advance of the vehicle.

As shown in FIG. 7, FIG. 8 and FIG. 10, the second light source unit 3B has at least one or a plurality of (in the embodiment, one) second light emitting elements 8, a second heat conductive substrate 9 on which the second light emitting elements 8 are mounted, and a second reflector 10B configured to reflect the second light L2 emitted from the second light emitting elements 8 in the direction of advance of the vehicle.

The second light emitting elements 8 are constituted by chip LEDs (SMD LEDs) configured to emit white light as the second light L2. In addition, a high output type LED for vehicle illumination is used for the chip LED. The second light emitting elements 8 are disposed on the surface of the second heat conductive substrate 9. The second light emitting elements 8 radially emit the second light L2 toward the second reflector 10B provided downward.

In the lighting tool 1B for a vehicle of the embodiment, a second heat conductive substrate (a mounting substrate) 9 on which the second light emitting elements 8 are mounted and a circuit board (not shown) on which a driving circuit configured to drive the second light emitting elements 8 is provided are separately disposed inside a light body, the mounting substrate and the circuit board are electrically connected via a wiring cord that is referred to as a harness, and the driving circuit is protected from heat emitted from the second light emitting elements 8.

Further, the first heat conductive substrate 5 and the second heat conductive substrate 9 may be formed of the same material or may be formed of different materials. In addition, the circuit board on which the driving circuit configured to drive the first light emitting elements 4 is provided and the circuit board on which the driving circuit configured to drive the second light emitting elements 8 is provided may be integrated with each other or may be provided separately from each other.

Meanwhile, the second heat conductive substrate 9 is larger than the first heat conductive substrate 5 and has a substrate mounting region 9*a* on a surface of a side thereof, on which the second light emitting elements 8 is mounted. The first heat conductive substrate 5 is mounted on the substrate mounting region 9*a* via the thermal conductive sheet 13. Accordingly, the first heat conductive substrate 5 is thermally bonded to the second heat conductive substrate 9 in a state in which they overlap each other. Further, the thermal conductive sheet 13 may be omitted in some cases.

When the first heat conductive substrate 5 and the second heat conductive substrate 9 are laminated, the first and second heat conductive substrates 5 and 9 function as a radiation member. In particular, in the region (the substrate mounting region 9*a*) in which the first heat conductive substrate 5 and the second heat conductive substrate 9 are laminated, since the region has a thickness two times larger than the region in which they are not laminated, a thermal capacity is increased. Accordingly, in comparison with the case in which the first heat conductive substrate 5 and the second heat conductive substrate 9 are not laminated, larger current can flow to the plurality of first light emitting elements 4.

Further, since heat dissipation in the substrate mounting region 9*a* of the second heat conductive substrate 9 is improved, a radiation area can also be increased by performing unevenness processing or the like on the second heat conductive substrate 9.

The second reflector 10B has a plurality of reflecting surfaces 10*b* formed of a resin material such as poly carbonate or the like and each having an inner surface formed of an aluminum-based reflection metal material. The second reflector 10B is disposed to cover the second heat conductive substrate 9 from below, in a state in which the second light emitting elements 8 are directed downward. Accordingly, a surface (an inner surface) of the second reflector 10B facing the second light emitting elements 8 become the plurality of reflecting surfaces 10*b*. Among the plurality of reflecting surfaces 10*b*, the reflecting surface 10*b* configured to form a cutoff line (CL) is also formed.

As shown in FIG. 10, each of the reflecting surfaces 10*b* of the second reflector 10B is formed to be curved to described a parabola on a cross section (an X-axis cross section) in the forward/rearward direction (the X-axis direction) from a base end (rear end) side to a tip (front end) side using a center (an emission point) of the second light emitting elements 8 as a focus.

Accordingly, the second reflector 10B reflects the second light L2 emitted from the second light emitting elements 8 to become parallel beams in the direction of advance of the vehicle (the +X-axis direction) using the plurality of reflecting surfaces 10*b*. In addition, as shown in FIG. 7, the plurality of reflecting surfaces 10*b* are constituted by composite reflecting surfaces, each of which is formed to be divided into a plurality of regions, and an irradiating direction and an irradiating range of a reflecting direction of each of the reflecting surfaces 10*b*, in particular, the leftward/rightward direction, is controlled.

In the embodiment, the first reflector 6B and the second reflector 10B are formed integrally with each other. Accordingly, the first heat conductive substrate 5 and the second heat conductive substrate 9 are attached integrally with the first reflector 6B and the second reflector 10B in a state in which they overlap each other.

Specifically, a pair of bosses 14 in which screw holes 14*a* are formed are provided on the first reflector 6B and the second reflector 10B. Meanwhile, a pair of through-holes 15 are formed in the first heat conductive substrate 5. In addition, a through-hole 16 is formed in the second heat conductive substrate 9 at a position overlapping one of the through-holes 15. Accordingly, in a state in which the first heat conductive substrate 5 and the second heat conductive substrate 9 are overlapped with each other, since the screws 17 are screwed into the screw holes 14*a* through the through-holes 15 and 16, the first heat conductive substrate 5 and the second heat conductive substrate 9 can be attached integrally with the first reflector 6B and the second reflector 10B.

Further, the first reflector 6B and the second reflector 10B are not limited to the case in which they are configured integrally with each other and may be configured separately from each other.

In the second light source unit 3B, when the second light L2 emitted from the second light emitting elements 8 is reflected while adjusting a light distribution using the plurality of reflecting surfaces 10*b* of the second reflector 10B, a light distribution pattern for a low beam (LB) including a cutoff line CL at an upper end is formed. Further, like the light distribution pattern P4 for LB shown in FIG. 6, a light distribution of the light distribution pattern for LB of the embodiment is controlled.

That is, the light distribution pattern P4 for LB are formed below a horizontal line in a state in which they are disposed below or partially overlap the light distribution patterns P1 to P3 for ADB. The light distribution pattern for a traveling beam (a high beam) is formed below and above the horizontal line by a synthetic light distribution of the light distribution pattern P4 for LB and the light distribution patterns P1 to P3 for ADB.

In the lighting tool 1B for a vehicle of the embodiment having the above-mentioned configuration, when the first light source unit 2B and the second light source unit 3B are configured integrally with each other, the number of parts can be reduced and further reduction in size can be achieved.

In addition, in the lighting tool 1B for a vehicle of the embodiment, the first heat conductive substrate 5 is thermally bonded to the second heat conductive substrate 9 in a state in which they overlap each other. Accordingly, there is no need to secure a space in which a circuit board is disposed on each of the light source units like in the related art, and a compact design in a size of the light body can be achieved.

In addition, in the lighting tool 1B for a vehicle of the embodiment, when the first light source unit 2B is turned ON, heat emitted from the first light emitting elements 4 can be efficiently radiated from the first heat conductive substrate 5 to the second heat conductive substrate 9.

Further, when any one of the first light source unit 2B and the second light source unit 3B is turned ON, heat dissipation performance can be maintained even more by turning OFF the other light source unit.

Further, in the lighting tool 1B for a vehicle, while the first light emitting elements 4 and the second light emitting elements 8 are provided downward, the first light emitting elements 4 and the second light emitting elements 8 may be provided upward and may be covered with the first reflector 6B and the second reflector 10B from above.

Further, the present invention is not particularly limited to the embodiment and various modifications may be made without departing from the scope of the present invention.

For example, the second light source units 3A and 3B are not limited to the case in which the light source unit for ADB is configured and, for example, may be replaced with a light source unit for a high beam (HB) that forms a light distribution pattern for a conventional high beam, a light source unit for a cornering lamp that functions as a cornering lamp, or the like.

In addition, the first light source units 2A and 2B may be configured using a separator or the like disposed to partition the plurality of first light emitting elements 4 and divide an emission surface according to each of the first light emitting elements 4 such that the first light L1 emitted from each of the first light emitting elements 4 is reflected toward a side in front of the vehicle, instead of using the first reflectors 6A and 6B.

In addition, the first light emitting elements 4 and the second light emitting elements 8 may use light emitting elements such as laser diodes (LDs) or the like, in addition to the above-mentioned LEDs. In addition, the number of the first light emitting elements 4 is not limited to three, which has been described above, and may be two or four or more. Meanwhile, the number of the second light emitting elements 8 is not limited to one, which has been described above, and may be two or more.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A lighting tool for a vehicle comprising:

a first light source unit having a plurality of first light emitting elements, a first heat conductive substrate on which the first light emitting elements are mounted, and a first reflector configured to reflect light emitted from the first light emitting elements toward a direction of advance of the vehicle; and a second light source unit having at least one or a plurality of second light emitting elements and a second heat conductive substrate on which the second light emitting element is mounted, and a second reflector configured to reflect light emitted from the second light emitting element in the direction of advance of the vehicle, wherein the first heat conductive substrate is formed so as to extend from the first light source unit to the second light source unit, wherein the first heat conductive substrate is thermally bonded to the second heat conductive substrate in a state in which the first heat conductive substrate and the second heat conductive substrate are overlapped with each other, wherein the plurality of first light emitting elements of the first light source unit include at least two light emitting elements in which switching of turning ON and OFF thereof are individually controlled, and wherein among the two light emitting elements, a light distribution pattern formed by turning ON one of the two light emitting elements and a light distribution pattern formed by turning ON the other one of the two light emitting elements are formed at different positions with respect to each other in a horizontal direction.

2. The lighting tool for a vehicle according to claim 1, wherein the second heat conductive substrate has a substrate mounting region on a surface at a side on which the second light emitting element is mounted, and the first heat conductive substrate is thermally bonded to the second heat conductive substrate while the first heat conductive substrate being mounted in the substrate mounting region.

3. The lighting tool for a vehicle according to claim 1, wherein the first heat conductive substrate and the second heat conductive substrate comprise metal plate.

4. The lighting tool for a vehicle according to claim 1, wherein the second light source unit has a shade configured to form a cutoff line by partially blocking some of the light emitted from the second light emitting element and radiated toward a front of the vehicle, and the second light source unit is configured to form a light distribution pattern for a passing beam.

5. The lighting tool for a vehicle according to claim 1, wherein the second reflector includes a plurality of reflecting surfaces, and is configured to form a light distribution pattern comprising a cutoff line at an upper end thereof by reflecting light emitted from the second light emitting element using the plurality of reflecting surfaces.

6. A lighting tool for a vehicle comprising:

a first light source unit having a plurality of first light emitting elements, a first heat conductive substrate on which the first light emitting elements are mounted, and a first reflector configured to reflect light emitted from the first light emitting elements toward a direction of advance of the vehicle; and a second light source unit having at least one or a plurality of second light emitting elements and a second heat conductive substrate on which the second light emitting element is mounted, and a second reflector configured to reflect light emitted from the second light emitting element in the direction of advance of the vehicle, wherein the first heat conductive substrate is formed so as to extend from the first light source unit to the second light source unit, wherein the first heat conductive substrate is thermally bonded to the second heat conductive substrate in a state in which the first heat conductive substrate and the second heat conductive substrate are overlapped with each other, wherein the plurality of first light emitting elements of the first light source unit include at least three light emitting elements in which switching of turning ON and OFF thereof are individually controlled, the three light emitting elements are aligned in a leftward/rightward direction on one side of the first heat conductive substrate, and the three light emitting elements are controlled so as to turn OFF one of the three light emitting elements and to turn ON a remainder of the three light emitting elements based on information recognized by a camera.

7. The lighting tool for a vehicle according to claim 1, wherein the first and second reflectors are formed by using aluminum or polycarbonate.

8. The lighting tool for a vehicle according to claim 5, wherein, among the two light emitting elements of the first light source unit, the light distribution pattern formed by turning ON one of the two light emitting elements is a light distribution pattern which is radiated upward to a greater degree than the light distribution pattern which is formed by turning ON the second of the light emitting elements, which includes the cutoff line and which is radiated by the second light source unit.

9. The lighting tool for a vehicle according to claim 6, wherein the second heat conductive substrate has a substrate mounting region on a surface at a side on which the second light emitting element is mounted, and the first heat conductive substrate is thermally bonded to the second heat conductive substrate while the first heat conductive substrate being mounted in the substrate mounting region.

10. The lighting tool for a vehicle according to claim 6, wherein the first heat conductive substrate and the second heat conductive substrate comprise metal plate.

11. The lighting tool for a vehicle according to claim 6, wherein the second light source unit has a shade configured to form a cutoff line by partially blocking some of the light emitted from the second light emitting element and radiated toward a front of the vehicle, and the second light source unit is configured to form a light distribution pattern for a passing beam.

12. The lighting tool for a vehicle according to claim 6, wherein the second reflector includes a plurality of reflecting surfaces, and is configured to form a light distribution pattern comprising a cutoff line at an upper end thereof by reflecting light emitted from the second light emitting element using the plurality of reflecting surfaces.

13. The lighting tool for a vehicle according to claim 6, wherein the first and second reflectors are formed by using aluminum or polycarbonate.

* * * * *